US005956546A

United States Patent [19]

Tsuchiya

[11] Patent Number: 5,956,546

[45] **Date of Patent: *Sep. 21, 1999**

[54] ELECTROPHOTOGRAPHIC IMAGE FORMING APPARATUS HAVING FIRST AND SECOND MOUNTING MEANS TO ALLOW SMOOTH MOVEMENT OF A DEVELOPING ROLLER

[75] Inventor: Yoshiro Tsuchiya, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/804,272

[22] Filed: Feb. 21, 1997

[30] Foreign Application Priority Data

Feb. 27, 1996 [JP] Japan ..... 8-065223

[51] Int. Cl.[6] ..... G03G 15/04

[52] U.S. Cl. ..... 399/119; 399/227

[58] Field of Search ..... 399/119, 222, 399/227, 228, 226

[56] References Cited

U.S. PATENT DOCUMENTS

| | | | |
|---|---|---|---|
| 4,772,916 | 9/1988 | Mochida | 399/227 |
| 4,782,360 | 11/1988 | Iwamoto et al. | 399/227 |
| 4,970,561 | 11/1990 | Mizuno | 399/228 |
| 5,089,849 | 2/1992 | Hiraoka | 399/119 |
| 5,198,866 | 3/1993 | Kimura et al. | 399/222 |
| 5,294,967 | 3/1994 | Munakata et al. | 399/227 |
| 5,369,475 | 11/1994 | Kashiwagi | 399/119 |
| 5,432,590 | 7/1995 | Nomura et al. | 355/200 |
| 5,612,769 | 3/1997 | Sugihara et al. | 399/119 |
| 5,640,229 | 6/1997 | Nakahara | 399/119 |

*Primary Examiner*—Robert Beatty

*Attorney, Agent, or Firm*—Fitzpatrick, Cella, Harper & Scinto

[57] ABSTRACT

An electrophotographic image forming apparatus capable of forming a multicolor image on a recording medium, includes a first mounting arrangement for detachably mounting a photosensitive member cartridge having an electrophotographic photosensitive member, and a second mounting arrangement for detachably mounting a developing cartridge having a developer roller for developing a latent image formed on said electrophotographic photosensitive member. The developer cartridge is swingably provided about a swing center so that the cartridge is shiftable in parallel with an axis of said electrophotographic photosensitive member.

34 Claims, 6 Drawing Sheets

ELECTROPHOTOGRAPHIC IMAGE FORMING APPARATUS HAVING FIRST AND SECOND MOUNTING MEANS TO ALLOW SMOOTH MOVEMENT OF A DEVELOPING ROLLER

BACKGROUND OF THE INVENTION

1. Field of the Invention

The present invention relates to an electrophotographic image forming apparatus such as a copying machine or printer, which forms an image on a recording medium by using an electrophotographic image forming process.

2. Related Background Art

In a conventional multicolor electrophotographic image forming apparatus using an electrophotographic image forming process, an electrophotographic photosensitive member and a process means acting thereon are integrated into a cartridge, and the cartridge is detachably mounted in the electrophotographic image forming apparatus. That is, this apparatus uses a process cartridge scheme (a developing unit is mounted separately). According to this process cartridge scheme, since maintenance of the apparatus can be performed by the user himself/herself instead of a serviceman, a great improvement in operability can be attained. For this reason, this process cartridge scheme is widely used in multicolor electrophotographic image forming apparatuses.

In such a process cartridge scheme, a process cartridge is inserted into the mounting means of an electrophotographic image forming apparatus body and fixed at a predetermined position. Developing rollers for different colors are selectively pressed against the electrophotographic photosensitive member of this process cartridge or the electrophotographic photosensitive member directly mounted on the electrophotographic image forming apparatus body.

SUMMARY OF THE INVENTION

It is an object of the present invention to provide an electrophotographic image forming apparatus, which can smoothly move a developer bearing member used for a developing process to a developing position.

It is another object of the present invention to provide an electrophotographic image forming apparatus, which allows a developer bearing member to smoothly move to a developing position with little resistance to movement.

It is still another object of the present invention to provide an electrophotographic image forming apparatus, which can maintain an electrophotographic photosensitive member and a developer bearing member parallel when developing is performed.

It is still another object of the present invention to provide an electrophotographic image forming apparatus in which the pressing force acting between an electrophotographic photosensitive member and a developer bearing member in the longitudinal direction varies little when developing is performed.

DETAILED DESCRIPTION OF THE PREFERRED EMBODIMENTS (First Embodiment)

The longitudinal direction in this embodiment is the direction perpendicular to the convey direction of a transfer medium (recording medium) and parallel with the transfer medium.

The first embodiment of the present invention will be described below with reference to the accompanying drawings.

[Description of Overall Electrophotographic Image Forming Apparatus]

Figure 1:
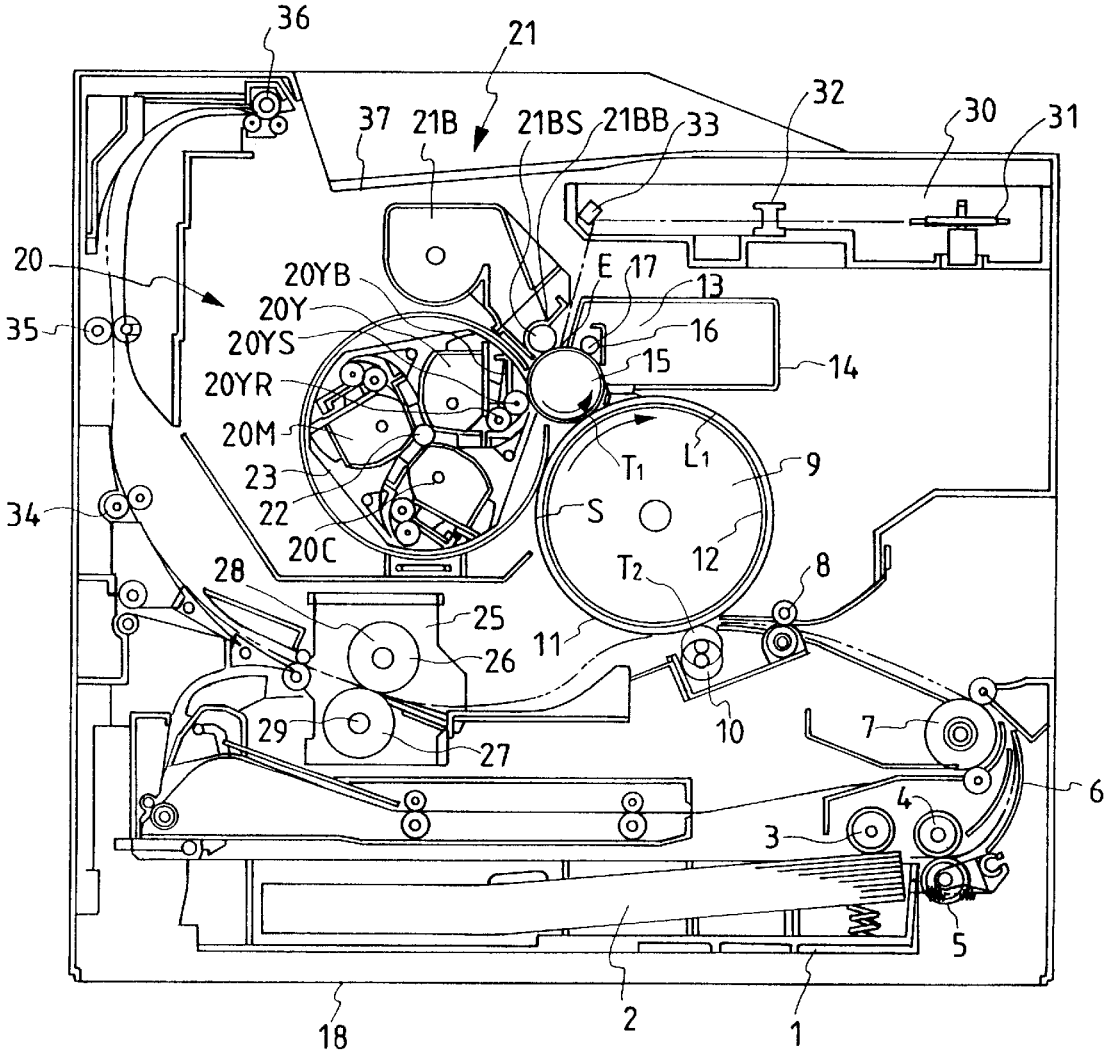
FIG. 1 is a longitudinal sectional view of a color laser printer to which an embodiment of the present invention is applied.

The overall arrangement of a color electrophotographic image forming apparatus will be briefly described first with reference to FIG. 1.

FIG. 1 is a sectional view for explaining the overall arrangement of a laser printer as an embodiment of the color electrophotographic image forming apparatus.

As shown in FIG. 1, the color laser printer includes an image forming unit constituted by an electrophotographic photosensitive drum 15 as an image bearing member, which rotates at a constant speed, a fixed black developing unit 21B, and three color developing units 20Y, 20M, and 20C, which are capable of indexing rotation with respect to the photosensitive drum 15, and an intermediate transfer medium 9 which holds a color image developed and multi-transferred by the image forming unit and further transfers the image onto a transfer medium 2 fed from a feed unit. The transfer medium 2, onto which the color image is transferred, is conveyed to a fixing unit 25 to fix the color image on the transfer medium 2. The transfer medium 2 is then discharged onto a discharge unit 37 on the upper surface of the apparatus by discharge roller pairs 34, 35, and 36. Note that the color developing units 20Y, 20M, and 20C capable of indexing rotation and the black developing unit 21B are designed to be individually detachable with respect to a main body 18 of an electrophotographic image forming apparatus (apparatus body 18).

The arrangement of each unit of the above electrophotographic image forming apparatus will be described next in detail.

[Process Cartridge]

A process cartridge 13 used in this embodiment integrally incorporates a electrophotographic photosensitive drum 15, a cleaning blade 16, a primary charging means 17, and a cleaning container 14 also serving as the holder of the electrophotographic photosensitive drum 15. This process cartridge 13 is designed to be detachably supported in the electrophotographic image forming apparatus body 18 and is easily replaced with a new cartridge in accordance with the service life of the electrophotographic photosensitive drum 15. The electrophotographic photosensitive drum 15 according to this embodiment is obtained by coating the outer surface of an aluminum cylinder with an organic photoconductive layer. The photosensitive drum 15 is rotatably supported on the cleaning container 14 also serving as the holder of the photosensitive drum 15.

In the cleaning container 14, the cleaning blade 16 and the primary charging means 17 are disposed on the outer surface of the photosensitive drum 15. The photosensitive drum 15 is partly exposed from the cleaning container 14. A driving force is transferred from a driving motor (not shown) to one end of the photosensitive drum 15 on the rear side to rotate the photosensitive drum 15 in the counterclockwise direction in FIG. 1 in accordance with an image forming operation. The charging means 17 in the process cartridge 13 uses a contact charging method. That is, the conductive roller is brought into contact with the photosensitive drum 15, and a voltage is applied to the conductive roller to uniformly charge the surface of the photosensitive drum 15.

Note that the process cartridge is not limited to the one described above. For example, the charging means, the cleaning means, and the electrophotographic photosensitive member are integrated into a cartridge, and the cartridge is detachably mounted in the electrophotographic image forming apparatus. Alternatively, the electrophotographic photosensitive member and at least one of the charging means and the cleaning means are integrated into a cartridge, and the cartridge is detachably mounted in the electrophotographic image forming apparatus.

[Exposure Means]

Exposure to the photosensitive drum 15 is performed by a scanner unit 30. More specifically, when an image signal is supplied to the laser diode, the laser diode irradiates image light corresponding to the image signal onto a polygon mirror 31. The polygon mirror 31 is rotated at a high speed by the scanner motor. The image light reflected by the polygon mirror 31 selectively exposes through an imaging lens 32 and a reflecting mirror 33 the surface of the photosensitive drum 15 which rotates at a constant speed. As a result, an electrostatic latent image is formed on the photosensitive drum 15.

[Developing Means]

Developing means 20 and 21 are constituted by the three color developing units 20Y, 20M, and 20C and the one black developing unit 21B which can perform developing of the respective colors, i.e., yellow, magenta, cyan, and black so as to visualize the above electrostatic latent image. The developing means 20 will be described in more detail later.

The black developing unit 21B of the developing means 21 is a stationary developing unit. A developing roller 21BS of the black developing unit 21B is disposed as a developer bearing member to be slightly spaced apart from the photosensitive drum 15. The black developing unit 21B forms a toner image on the photosensitive drum 15 by using a black toner. The black developing unit 21B feeds a toner from the container with a feed mechanism to coat the outer surface of the developing roller 21BS, which rotates in the clockwise direction in FIG. 1, with a thin toner layer by using a coating blade 21BB pressed against the outer surface of the developing roller 21BS, and applies charges to the toner (frictional charging). In addition, a developing bias is applied to the developing roller 21BS to supply a toner to the photosensitive drum 15 and perform toner development in correspondence with the electrostatic latent image on the photosensitive drum 15.

[Sheet feed Unit]

The sheet feed unit feeds the transfer medium 2 to the image forming unit. The sheet feed unit is mainly constituted by a sheet feed cassette 1 storing a plurality of sheets of transfer media, pickup rollers 3, a sheet feed roller 4, a retardation roller 5 to prevent "double-sheet feed", a sheet guide 6, and registration rollers 8. In an image forming operation, the pickup roller 3 rotates in accordance with the image forming operation to feed transfer media 2 in the sheet feed cassette 1 one by one, and the transfer medium 2 is guided by the sheet guide 6 to reach the registration rollers 8 through a convey roller 7. During the image forming operation, the registration rollers 8 perform a non-rotating operation to stop the transfer medium 2 and a rotating operation to convey the transfer medium 2 toward the intermediate transfer medium 9 in accordance with a predetermined sequence, thereby positioning the image and the transfer medium 2 in the transfer step, which is the next step.

[Transfer Unit]

The transfer unit has a swingable transfer roller 10.

The transfer roller 10 is obtained by winding an intermediate-resistance foamed elastic member around a metal shaft. The transfer roller 10 can move in the vertical direction in FIG. 1 and rotates upon reception of a driving force. While a four-color toner image is formed on the intermediate transfer medium 9, i.e., the intermediate transfer medium 9 rotates a plurality of numbers of times, the transfer roller 10 is located at the lower position indicated by the solid line in FIG. 1 to be separated from the intermediate transfer medium 9 so as not to disturb the image. After the four-color toner image is formed on the intermediate transfer medium 9, the transfer roller 10 is moved to the upper position indicated by the thin line in FIG. 1, i.e., pressed against the intermediate transfer medium 9 with a predetermined pressure through the transfer medium 2, by a cam member (not shown) in accordance with the timing of transfer of the color image onto the transfer medium 2. At the same time, a bias is applied to the transfer roller 10 to transfer the toner image from the intermediate transfer medium 9 onto the transfer medium 2. In this case, since the intermediate transfer medium 9 and the transfer roller 10 are driven, the transfer medium 2 sandwiched therebetween is conveyed to the left in FIG. 1 at a predetermined speed and fed to the fixing unit 25 as the next step at the same time the transfer step is performed.

[Fixing Unit]

The fixing unit 25 fixes the toner image, which is formed by the developing means 20 and 21 and transferred onto the transfer medium 2 through the intermediate transfer medium 9. As shown in FIG. 1, the fixing unit is constituted by a fixing roller 26 for applying heat to the transfer medium 2 and a press roller 27 for pressing the transfer medium 2 against the fixing roller 26. These rollers are hollow rollers respectively incorporating heaters 28 and 29. Each roller is rotated to convey the transfer medium 2. That is, the transfer medium 2 holding the toner image is conveyed by the fixing roller 26 and the press roller 27, and at the same time, the toner image is fixed on the transfer medium 2 upon application of heat and pressure.

[Image Forming Operation]

An image forming operation performed by the apparatus having the above arrangement will be described next with reference to FIG. 2.

First of all, the pickup roller 3 in FIG. 1 is rotated to separate one transfer medium 2 from the sheet feed cassette 1, and the transfer medium 2 is conveyed to the registration rollers 8. Meanwhile, the photosensitive drum 15 and the intermediate transfer medium 9 rotate in the directions indicated by the arrows in FIG. 2 at the same peripheral speed.

The three color developing units 20Y, 20M, and 20C of the developing means 20 are detachably held by a developing rotary unit 23 which rotates about a center shaft 22. In forming an image, the respective developing units rotate/move about the center shaft 22 while being held by the developing rotary unit 23, and a predetermined one of the developing units stops at a position where it opposes the photosensitive drum 15. The developing roller 20YS (or the developing roller 20MS or 20CS (not denoted by any reference symbols in FIG. 2) of the developing unit 20M or 20C) is positioned to oppose the photosensitive drum 15 through a small spacing (about 300 μm). Thereafter, the developing unit 20 forms a visual image in correspondence with the electrostatic latent image on the photosensitive drum 15. In forming a color image, the developing rotary unit 23 rotates every time the intermediate transfer medium 9 makes one revolution, thereby performing developing steps in the following order: the yellow developing unit 20Y, the magenta developing unit 20M, the cyan developing unit 20C, and the black developing unit 21B.

FIG. 1 shows a state wherein the yellow developing unit 20Y is positioned and remains stationary at a position where it opposes the process cartridge 13. The yellow developing unit 20Y feeds a toner from the container to a coating roller 20YR with the feed mechanism, and coats the outer surface of the developing roller 20YS, which rotates clockwise, with a thin toner layer using the coating roller 20YR, which rotates clockwise, and a developing blade 20YB pressed against the outer surface of the developing roller 20YS. In addition, the yellow developing unit 20Y applies charges to the toner (frictional charging). The yellow developing unit 20Y applies a developing bias to the developing roller 20YS opposing the photosensitive drum 15, on which a latent image is formed, to develop a toner image on the photosensitive drum 15 in accordance with the latent image. The magenta and cyan developing units 20M and 20C also perform toner development according to the same mechanism as described above.

When each of the color developing units 20Y, 20M, and 20C is moved to the developing position upon indexing rotation, each developing roller is connected to a high voltage source for developing of a corresponding color and to a drive member. Therefore, voltages are sequentially and selectively applied to the respective developing rollers and the driving members are connected thereto.

[Intermediate Transfer Medium]

Figure 2:
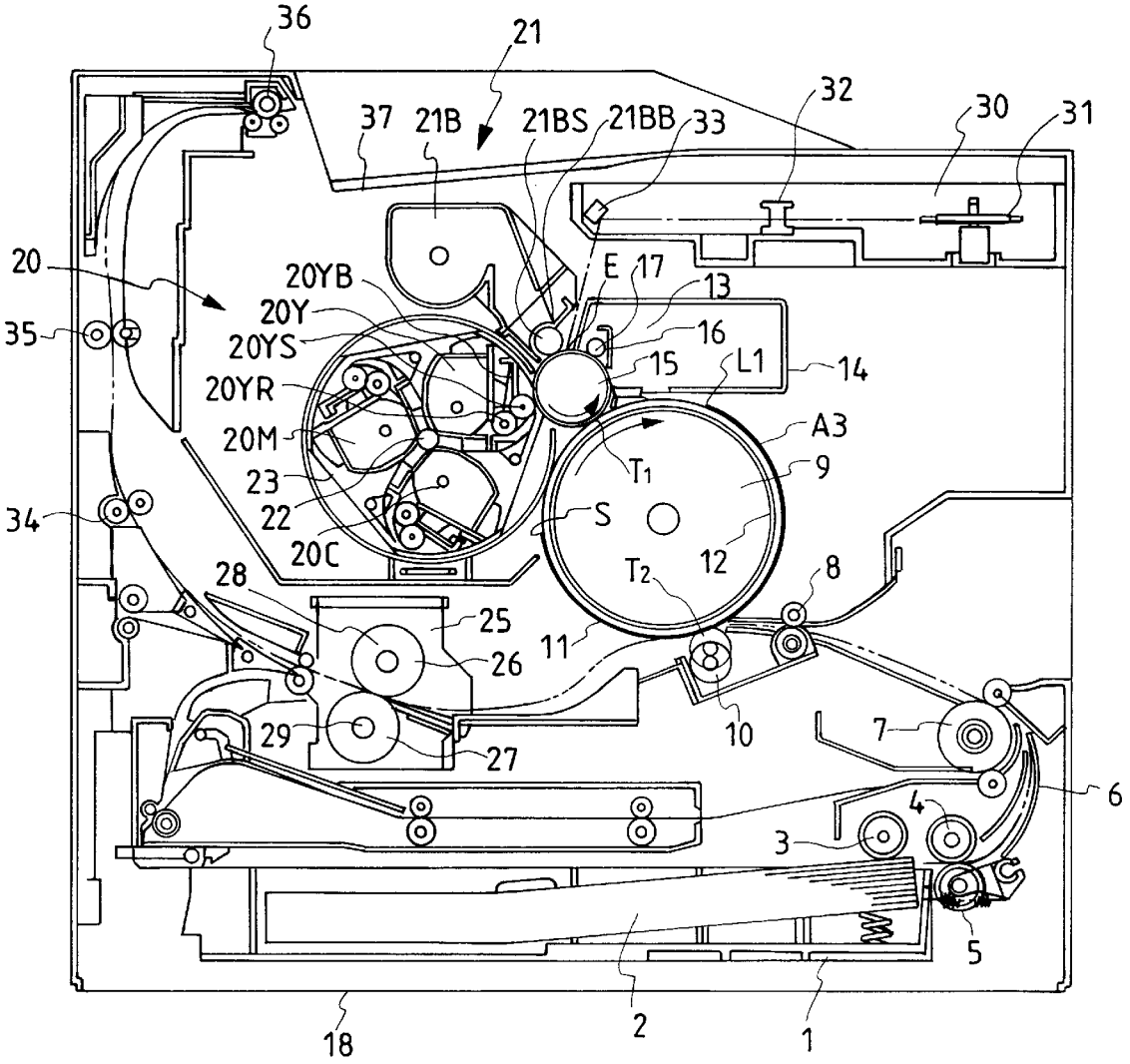
FIG. 2 is a longitudinal sectional view of the color laser printer, showing an image forming operation.

In a color image forming operation, the intermediate transfer medium 9 rotates in the clockwise direction in FIG. 2 in synchronism with the peripheral speed of the photosensitive drum 15 to be subjected to multi-transfer of four toner images (yellow (Y), magenta (M), cyan (C), and black (B) images) visualized on the photosensitive drum 15 by the color developing units 20Y, 20M, and 20C. The intermediate transfer medium 9 having undergone multi-transfer clamps and conveys the transfer medium 2, together with the transfer roller 10 to which a voltage is applied, to simultaneously transfer the toner images in the respective colors from the intermediate transfer medium 9 onto the transfer medium 2.

The intermediate transfer medium 9 according to the first embodiment is obtained by covering the outer surface of an aluminum cylinder 12 with an elastic layer 11 such as an intermediate-resistance sponge layer or intermediate-resistance rubber layer. The intermediate transfer medium 9 rotates upon reception of a driving force at a gear (not shown) rotatably supported and integrally fixed.

[Cleaning Means]

The cleaning blade 16 is integrally incorporated in the process cartridge 13 to be compressed against the generator of the photosensitive drum 15. The cleaning blade 16 cleans the photosensitive drum 15 by scraping off the toner left on the photosensitive drum 15 after an toner image formed as a visualized image on the photosensitive drum 15 by the developing means is transferred onto to the intermediate transfer medium 9. The waste toner is stored in the cleaning container 14. The cleaning container 14 is not filled with the waste toner to capacity before the end of the service life of the photosensitive drum 15. Therefore, the cleaning container 14 is replaced together with the photosensitive drum 15 at the same time the photosensitive drum 15 is replaced at the end of its service life.

When an arbitrary point on the outer surface of the intermediate transfer medium 9 comes to a position S in FIG. 2, the photosensitive drum 15 whose surface is uniformly charged by the primary charging means 17 is subjected to laser exposure at a position E in FIG. 2, thereby forming an image. The distance from the exposure position E on the photosensitive drum 15 to a first transfer position T1 corresponding to the contact portion between the photosensitive drum 15 and the intermediate transfer medium 9 in the counterclockwise direction is equal to the distance from the point S (FIG. 2) on the intermediate transfer medium 9 to the first transfer position T1. The point E, where the image write operation is started, coincides with the position S on the intermediate transfer medium 9 at the first transfer position T1 with the elapse of a time. That is, the image is formed on the intermediate transfer medium 9 counterclockwise from the point S.

(1) Formation of Yellow Image

The scanner unit 30 performs laser irradiation for an yellow image to form an yellow latent image on the photosensitive drum 15. At the same time, the yellow developing unit 20Y is driven to apply a voltage having the same polarity as that of the charge polarity of the photosensitive drum 15 and also having substantially the same potential as that thereof so as to cause an yellow toner to adhere to the latent image on the photosensitive drum 15, thus performing yellow development. At the same time, first transfer of the yellow toner image from the photosensitive drum 15 to the outer surface of the intermediate transfer medium 9 is performed at the first transfer position T1 located slightly downstream from the developing unit. A voltage opposite in polarity to the yellow toner is applied to the intermediate transfer medium 9 to perform a first transfer.

If, for example, an image is to be formed on a JIS A3-size sheet, the image is formed from the point S on the outer surface of the intermediate transfer medium 9 to a point L1 (see the thick line portion, on the outer surface of the intermediate transfer medium 9 in FIG. 2, which is denoted by reference symbol A3). When transfer of the yellow toner to the intermediate transfer medium 9 is completed, i.e., the point L1 passes through the first transfer position T1, the developing rotary unit 23 rotates counterclockwise, and the magenta developing unit 20M rotates/moves and is positioned to oppose the photosensitive drum 15.

(2) Formation of Magenta Image

When one point (the leading end of the yellow image) on the outer surface of the intermediate transfer medium 9 makes one revolution and comes to the point S in FIG. 2, the scanner unit 30 performs laser irradiation for a magenta image in the same manner as described above. As in the case of the formation of the yellow image, the latent image on the photosensitive drum 15 is developed into a magenta toner image, and the magenta toner image on the photosensitive drum 15 is transferred onto the intermediate transfer medium 9 at the first transfer position T1. When transfer of the magenta toner to the intermediate transfer medium 9 is completed, i.e., the point L1 passes through the first transfer position T1, the developing rotary unit 23 rotates clockwise, and the cyan developing unit 20C rotates/moves and is positioned to oppose the photosensitive drum 15.

(3) Formation of Cyan Image

When one point (the leading ends of the yellow and magenta images) on the outer surface of the intermediate transfer medium 9 makes one revolution and comes to the point S in FIG. 2, the scanner unit 30 performs laser irradiation for a cyan image in the same manner as described above. As in the case of the formation of the magenta image, the latent image on the photosensitive drum 15 is developed into a cyan toner image, and the cyan toner image on the photosensitive drum 15 is transferred onto the intermediate transfer medium 9 to be superposed on the yellow and magenta images at the first transfer position T1. When transfer of the cyan toner to the intermediate transfer medium 9 is completed, i.e., the point L1 passes through the first transfer position T1, the developing rotary unit 23 rotates through 60° clockwise. As a result, none of the color developing units 20Y, 20M, and 20C is present at the position opposite to the photosensitive drum 15.

(4) Formation of black Image

When one point (the leading ends of the yellow, magenta, and cyan images) on the outer surface of the intermediate transfer medium 9 makes one revolution and comes to the point S in FIG. 2, the scanner unit 30 performs laser irradiation for a black image in the same manner as described above. The black developing unit 21B then develops the latent image into a black toner image. The black toner image on the photosensitive drum 15 is transferred onto the intermediate transfer medium 9 at the first transfer position T1.

In the above manner, latent image formation, development, toner transfer onto the intermediate transfer medium 9 are sequentially performed four times in the following order yellow, magenta, cyan, and black, thereby forming a full-color image constituted by four types of toners, i.e., the yellow, magenta, cyan, and black toners, on the surface of the intermediate transfer medium 9.

Conveyance of the transfer medium 2 stopped at the registration rollers 8 described above is started at a predetermined timing before transfer of the black image onto the intermediate transfer medium 9 is completed, i.e., first transfer of the black toner image is completed and the image leading point S on the intermediate transfer medium 9, on which the full-color image is formed, reaches a second transfer position T2. At the same time, the transfer roller 10, which has been located at the lower position while the above images in the four colors were formed on the intermediate transfer medium 9, and has been kept out of contact with the intermediate transfer medium 9, is moved upward by the cam (not shown) to press the transfer medium 2 against the intermediate transfer medium 9 at the second transfer position T2. At the same time, a bias opposite in polarity to the toner is applied to the transfer roller 10. With this operation, the images in the four colors, i.e., the full-color image, on the intermediate transfer medium 9 are simultaneously transferred onto the transfer medium 2. When the transfer medium 2 passes through the second transfer position T2, the transfer medium 2 is separated from the intermediate transfer medium 9 and conveyed to the fixing unit 25 to be fixed. Thereafter, the transfer medium 2 is discharged onto the discharge unit 37 on the upper portion of the electrophotographic image forming apparatus body 18 through the discharge roller pairs 34, 35, and 36, with the image-formed surface facing down. The image forming operation is then completed.

[Detailed Description of Developing Means]

The developing means 20 in the present invention will be described next with reference to FIGS. 3 to 6. The manner in which the developing units 20Y, 20M, and 20C are mounted and positioned on the developing rotary unit 23 will be described first.

Figure 3:
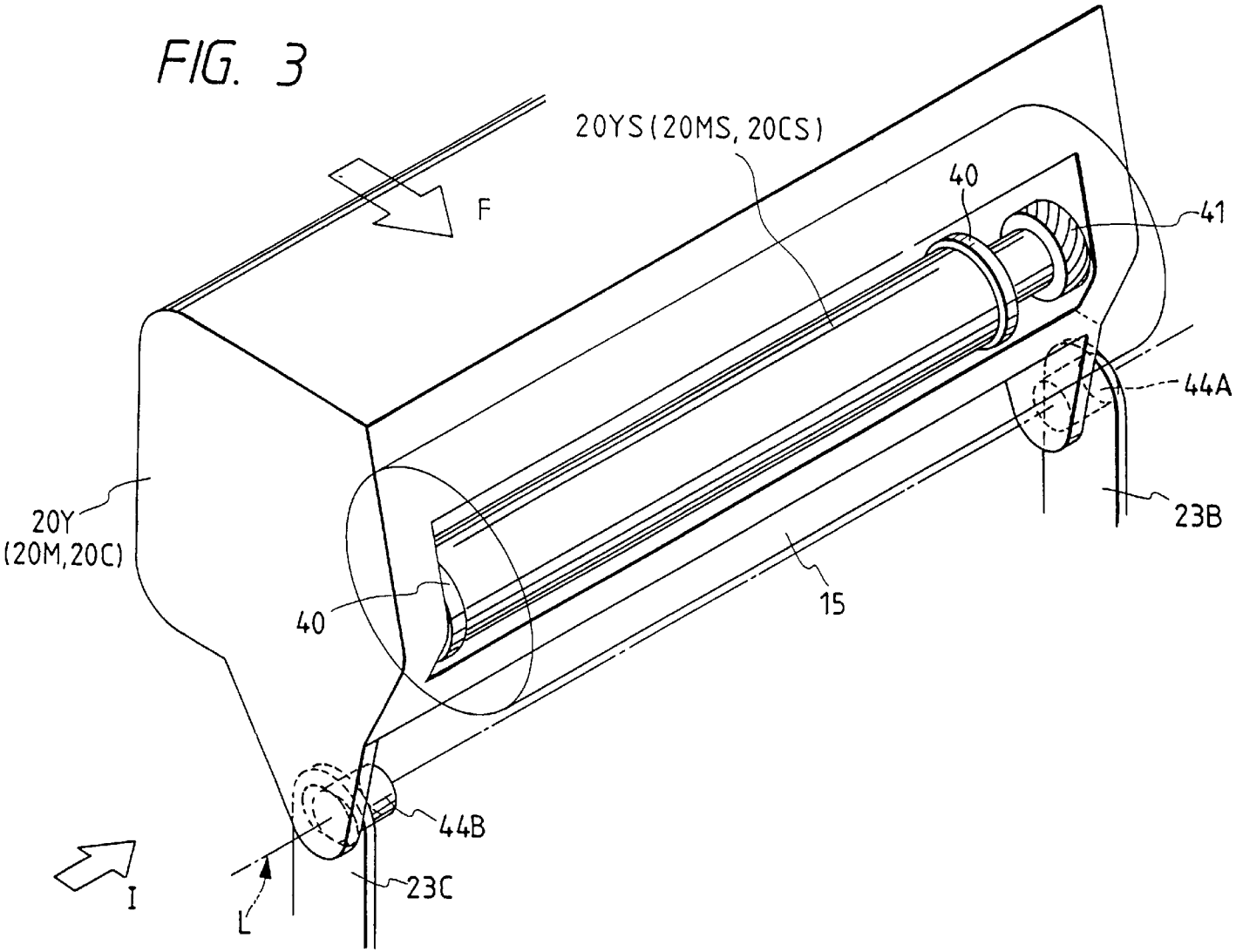
FIG. 3 is a perspective view showing the relationship between a developing unit, a developing rotary unit, and a photosensitive drum.
Figure 5:
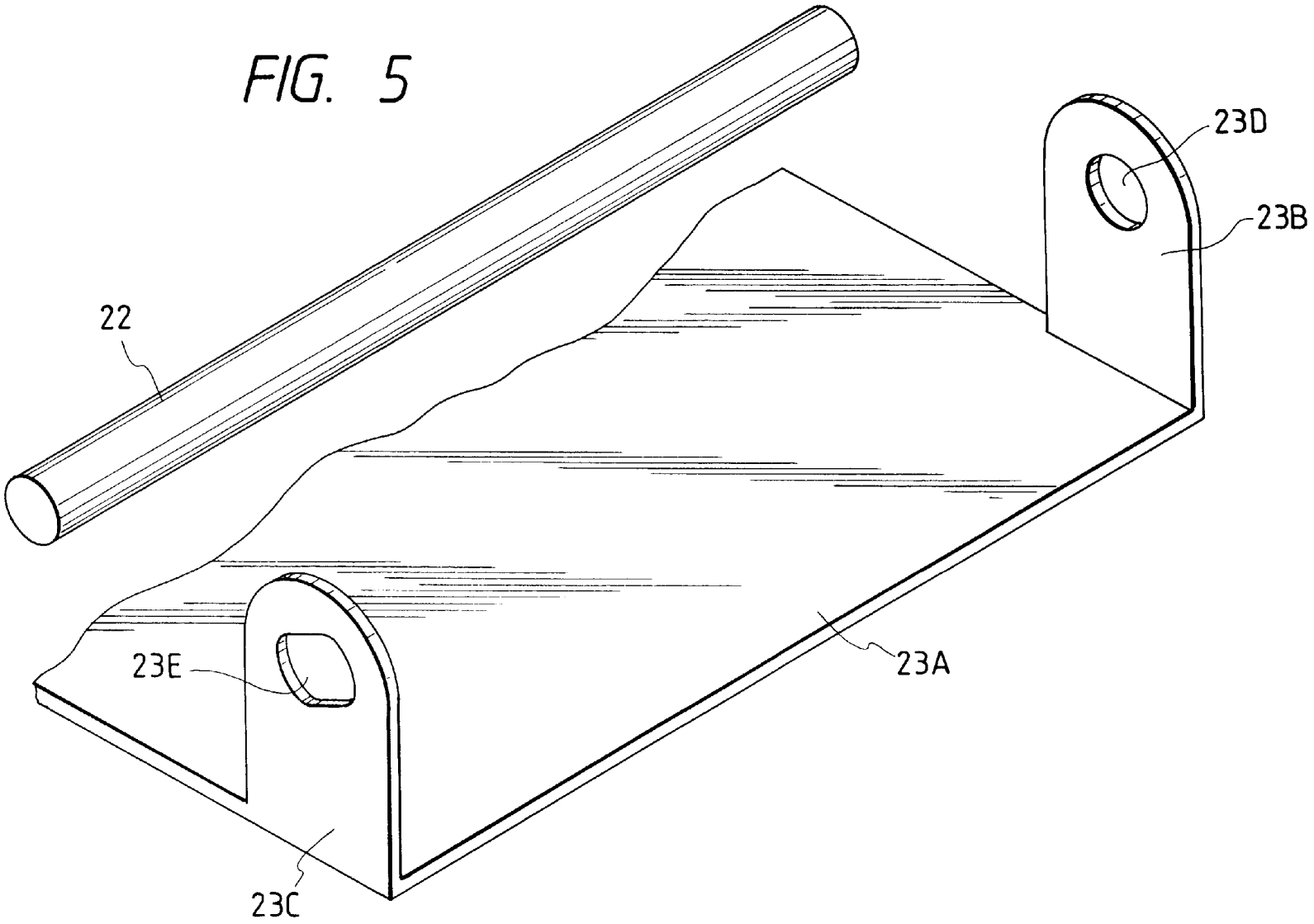
FIG. 5 is a perspective view showing part of the developing rotary unit.

As shown in FIG. 5, the developing rotary unit 23 has three stays 23A radially extending outward from the center shaft 22 at equal angular intervals to support the three developing units 20Y, 20M, and 20C. Developing unit support portions 23B and 23C for supporting one of the developing units 20Y, 20M, and 20C at the distal end portion of each stay 23A extend upright from the two ends in the longitudinal direction. FIG. 5 shows one of the three stays 23A. Referring to FIG. 5, the lower right portion is on the outer peripheral portion of the developing rotary unit 23, and the left upper portion indicated by the wavy line is on the center shaft 22 side. Swing center shafts 44A and 44B (see FIG. 3) fixed to each of the developing units 20Y, 20M, and 20C come into a round hole (almost true circle) 23D and an elliptic hole 23E respectively formed in the developing unit support portions 23B and 23C. FIG. 3 is a perspective view showing a state in which the developing units 20Y, 20M, and 20C are mounted on the developing rotary unit 23. In the state shown in FIG. 3, the developing unit 20Y is mounted on the developing unit support portions 23B and 23C of one of the stays 23A of the developing rotary unit 23 and is ready for development. When the developing unit 20Y is to be attached/detached to/from the electrophotographic image forming apparatus body 18, i.e., the developing rotary unit 23, the developing rotary unit 23 rotates to a position different from the developing position shown in FIG. 3, i.e., the position where the developing unit opposes the photosensitive drum 15. The developing unit 20Y is then attached/detached at this position. Note that the above-mentioned round hole is formed on the drive side.

In this embodiment, the developing units 20Y, 20M, and 20C are detached/attached to/from the electrophotographic image forming apparatus body 18 from the front surface side of the apparatus. That is, the developing units 20Y, 20M, and 20C are slid in the longitudinal direction to be attached/detached. The developing units 20Y, 20M, and 20C are inserted in the direction indicated by an arrow I in FIG. 3 to be mounted on the developing rotary unit 23. The developing rotary unit 23 has guides (not shown) through which the swing center shafts 44A and 44B of each of the developing units 20Y, 20M, and 20C can be inserted (fitted) in the holes 23D and 23E. Each of the developing units 20Y, 20M, and 20C is mounted on the developing rotary unit 23 along the guides.

After the developing units are mounted, they are fixed with stoppers (not shown) to prevent them from being removed in the thrust direction. While the developing units 20Y, 20M, and 20C are mounted on the developing rotary unit 23 in this manner, the developing units 20Y, 20M, and 20C can swing about their swing center shafts 44A and 44B fitted in the holes 23D and 23E. The developing rotary unit 23 is coupled to a rotation indexing device (not shown) to index and rotate about the center shaft 22 at angular intervals of 120° and at angular intervals of 60°.

Indexing rotation for developing, which is performed by the developing rotary unit 23 on which the developing units 20Y, 20M, and 20C are mounted will be described next.

Figure 6:
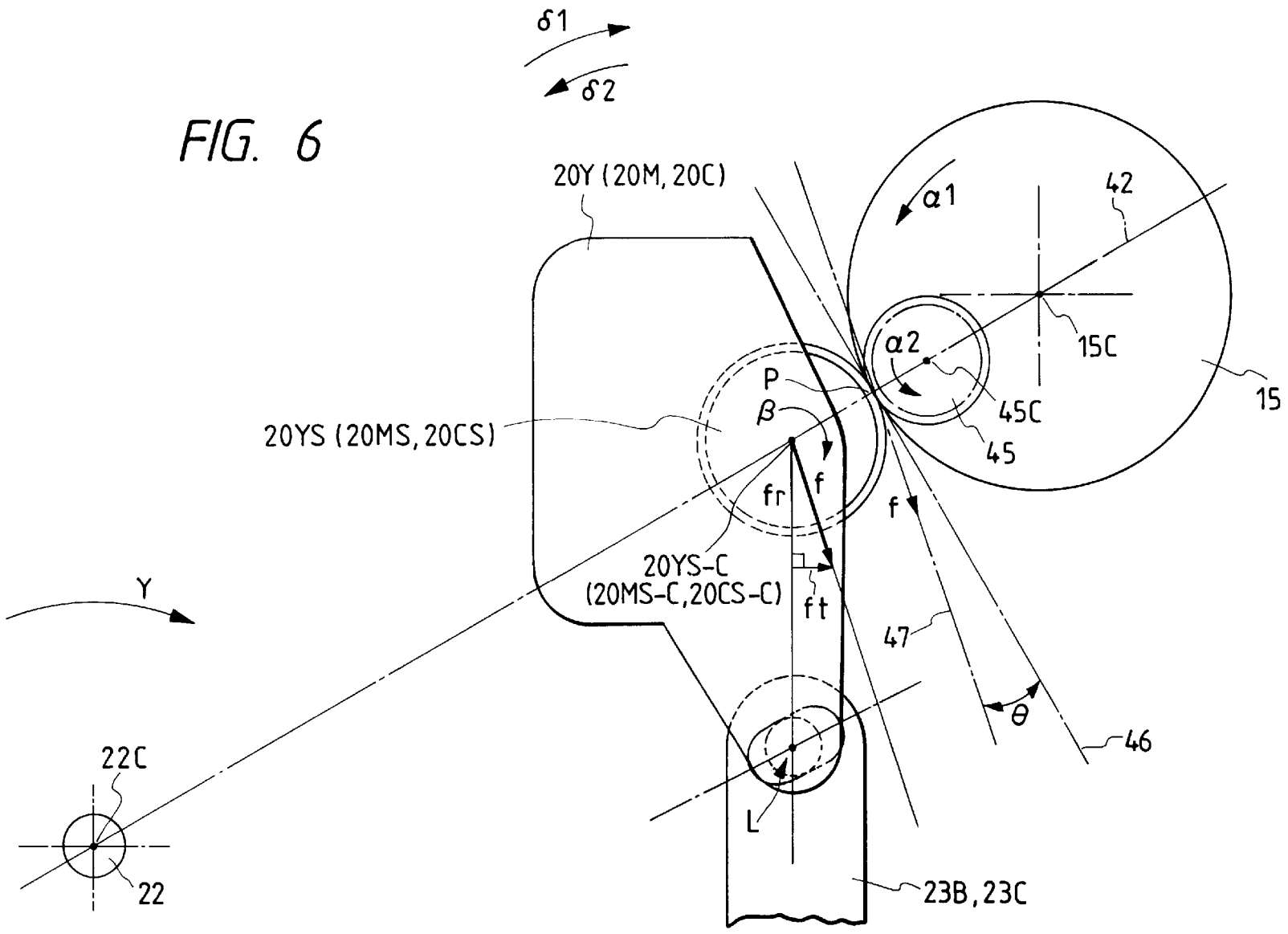
FIG. 6 is a side view showing the dynamic relationship between the developing unit, the developing rotary unit, and the photosensitive drum.

In the first embodiment, the rotational direction of the developing rotary unit 23 is the direction indicated by an arrow γ in FIG. 6. When an instruction (signal) to perform development is issued, the developing rotary unit 23 rotates such that one of the developing units 20Y, 20M, and 20C, a target unit, comes to the developing position where it opposes the photosensitive drum 15. In this case, the developing rotary unit 23 has a sensor (not shown) for detecting its indexed position and hence can accurately move/stop one of the developing units 20Y, 20M, and 20C to/at a predetermined position.

FIG. 6 is a perspective view showing the relationship between the photosensitive drum 15, the developing roller 20YS (20MS, 20CS), and the center shaft 22.

As shown in FIG. 6, centers 15C, 20YS-C, and 22C of these three members at the developing position are located on a single straight line 42. A center 45C of a driving gear 45, which is located on the apparatus body 18 side and drives the developing roller 20YS (20MS, 20CS), is also located on this straight line 42. The developing unit 20Y (20M, 20C) has a developing roller gear 41 (see FIG. 3) coaxially mounted on the developing roller 20YS (20M, 20CS). An external driving force is input to the driving gear 45, and a rotating force is transferred from the driving gear 45 to the developing roller gear 41, thereby driving the internal portion of the developing unit 20Y (20M, 20C). That is, when the developing unit 20Y (20M, 20C) comes to the developing position, the driving gear 45 on the apparatus body 18 side meshes with the developing roller gear 41. As a result, the developing unit 20Y (20M, 20C) is driven by the driving gear 45. When, therefore, the center 45C of the driving gear 45 is located on the above straight line 42 connecting the centers 15C, 20YS-C, and 22C of the photosensitive drum 15, the developing unit 20Y (20M, 20C), and the center shaft 22, and the developing rotary unit 23 stop at regular positions, the distance between the axes of the developing roller gear 41 and the driving gear 45 is minimized. Since the stop error of the developing rotary unit 23 increases with an increase in the distance between the axes of the developing roller gear 41 and the driving gear 45, damage to the gear and the like do not occur. Note that arrows $\alpha 1$, $\alpha 2$, and $\beta$ respectively represent the rotational directions of the photosensitive drum 15, the driving gear 45, and the developing unit 20Y (20M, 20C) and the developing roller gear 41.

Figure 4:
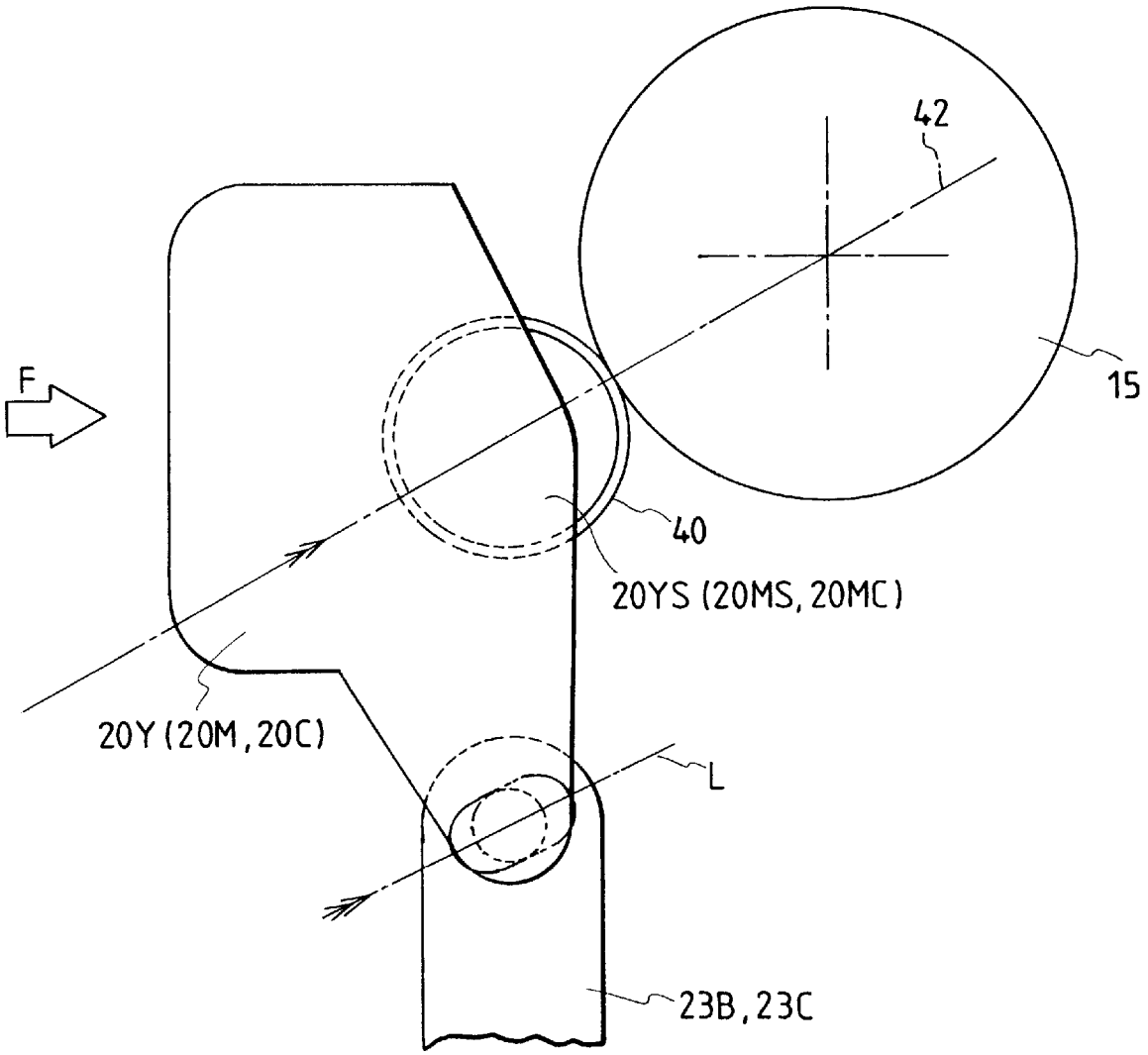
FIG. 4 is a side view showing the relationship between the developing unit, the developing rotary unit, and the photosensitive drum.

As shown in FIG. 3, abutment rollers 40, each having a radius larger than that of the developing unit 20Y (20M, 20C) by the developing gap, are mounted on the two end portions of the developing unit 20Y (20M, 20C) in the longitudinal direction. When one of the developing units 20Y, 20M, and 20C comes to the developing position, the abutment rollers 40 come into contact with the surface of the photosensitive drum 15 to position the developing unit 20Y (20M, 20C) with respect to the photosensitive drum 15. As shown in FIGS. 3 and 4, the developing unit 20Y (20M, 20C) is pressed against the photosensitive drum 15 with a force F of a spring (not shown). In order to perform development, it is very important to keep the clearance between the developing unit 20Y (20M, 20C) and the surface of the photosensitive drum 15 constant. With this arrangement, since the clearance between the two members is determined by only the dimensional precisions of the abutment rollers 40, a high clearance precision can be easily attained.

In order to reliably bring the abutment rollers 40 of the developing unit 20Y (20M, 20C) into contact with the surface of the photosensitive drum 15 at the developing position, the developing unit 20Y (20M, 20C) swings about a swing center L to slightly move toward the photosensitive drum 15 (in the direction indicated by an arrow $\delta 1$ in FIG. 6) at a position other than the developing position. The moving amount is about 1 mm. For this purpose, the developing rotary unit 23 has a stopper (not shown) to stop (restrict the swinging movement) the developing unit 20Y (20M, 20C) at the position where the abutment rollers 40 move by about 1 mm in the direction indicated by the arrow $\delta 1$ in FIG. 6 at a position other than the developing position. When the developing rotary unit 23 rotates, and the developing unit 20Y (20M, 20C) comes to the developing position, the abutment rollers 40 come into contact with the surface of the photosensitive drum 15. As a result, the developing unit 20Y (20M, 20C) swings about the swing center L in the direction indicated by the arrow $\delta 2$ to be positioned.

Assume that the swing center L (see FIG. 6) as the axis of the swing center shafts 44A and 44B of the developing unit 20Y (20M, 20C) is located before the developing roller 20YS (20MS, 20CS) in the rotating direction of the developing rotary unit 23 as in this embodiment while the developing rotary unit 23 rotates to bring the developing roller 20YS (20MS, 20CS) of the developing unit 20Y (20M, 20C) into contact with the photosensitive drum 15. In this case, the developing roller 20YS (20MS, 20CS) can smoothly come into contact with the photosensitive drum 15 (i.e., can freely retreat from the photosensitive drum 15).

Note that when the developing roller 20YS (20MS, 20CS) comes into contact with the photosensitive drum 15, both the abutment rollers 40 formed on the two ends of the developing roller 20YS (20MS, 20CS) need to come into contact with the photosensitive drum 15. In the first embodiment, the hole 23E in which the positioning shaft 44B for swingably supporting the non-drive side of the developing unit 20Y (20M, 20C) is fitted is an elliptic hole parallel with the straight line 42 connecting the center 15C of the photosensitive drum 15 and the centers 20YS-C (MS-C, CS-C), as shown in FIG. 5. With this structure, the developing unit 20Y (20M, 20C) is set in an equilibrium state by the spring with the force F, and the two abutment rollers 40 can come into contact with the surface of the photosensitive drum 15. Note that the hole 23D in which the positioning shaft 44A on the drive side is fitted is formed into a round hole (almost true circle) to ensure a high working precision between the developing roller gear 41 and the driving gear 45.

The dynamic relationship between the members in FIG. 6 when the developing unit 20Y (20M, 20C) is driven, and the relationship with the swing center L will be described finally with reference to FIG. 6.

As shown in FIG. 6, in a developing state, when the developing roller gear 41 of the developing unit 20Y (20M, 20C) is driven by the driving gear 45 on the apparatus body 18 side, a force f acts on the tooth surface in the direction of a line 47 of gear meshing action passing through a pitch point P. Referring to FIG. 6, an angle e is defined by the line 47 of action and a line 46 of contact on a pitch circle at the pitch point between the gears 41 and 45. This angle indicates the meshing pressure angle between the developing roller gear 41 and the driving gear 45. When the force f acts on the tooth surface, a load f also acts on the developing roller gear 41 in the same direction. This load f is decomposed into a normal load fr acting in a direction in which a developing roller center 20YS-C (20MS-C, 20CS-C) and the swing center L are connected to each other, and a tangent load ft acting in a direction perpendicular to the normal load fr. Since a component force ft acts as a rotating force with respect to the swing center L, a force acts on the developing unit 20Y (20M, 20C) in the direction indicated by the $\delta 1$, i.e., the direction in which the developing unit comes into contact with the photosensitive drum 15. The direction of this force is the same as the direction of the biasing force F, and the ratio of variations in contact pressure between the abutment rollers 40 and the photosensitive drum 15 is small. Development can be performed in a stable state.

In order to stably keep the abutment rollers 40 in contact with the photosensitive drum 15 in a developing state, a certain degree of force is required. However, the gear meshing force can help to achieve this purpose. For this reason, the biasing force F can be reduced by the gear meshing force. Therefore, the shock caused when the developing rotary unit 23 rotates to bring the abutment rollers 40 into contact with the photosensitive drum 15 can be reduced.

Since positioning of the photosensitive drum center 15C and the center shaft 22 of the developing rotary unit 23 is performed by using the same members, i.e., the side plates, a high relative position precision is ensured between the two members. That is, since the center shaft 22 of the developing rotary unit 23 of the developing means 20 is mounted on the side plates (not shown) on which the mounting means (not shown) of the process cartridge 13 is mounted, the developing units 20Y, 20M, and 20C are accurately positioned with respect to the photosensitive drum 15.

In the first embodiment, the photosensitive drum 15 is incorporated in the process cartridge 13. Instead of using the process cartridge 13, the photosensitive drum 15 may be mounted on the apparatus body 18. Even with this arrangement, the developing units 20Y, 20M, and 20C can be accurately positioned with respect to the photosensitive drum 15 by mounting both the photosensitive drum 15 and the developing means 20 on the same side plates in consideration of the same effect as that described above.

In the first embodiment, the developing means 20 has the three developing units 20Y, 20M, and 20C disposed in the form of a circle at equal angular intervals. However, these members need not be disposed in the form of a circle at equal angular intervals. For example, the present invention can be applied to a structure in which the three developing units are disposed in the form of a sector at angular intervals of 90° within the range of 0° to 180° with the center shaft 22 serving as the center.

In addition, when the developing roller is brought into direct contact with the photosensitive drum or is brought into contact with the photosensitive drum through the rollers mounted on the two ends of the developing roller, the longitudinal direction of the elliptic hole is parallel with a straight line connecting the axis of the photosensitive drum and the axis of the developing roller.

According to the above embodiment, the developing means includes the swing center shafts parallel with the drum-like electrophotographic photosensitive member, and supports the developer bearing member (e.g., a developing roller) to cause the developer bearing member to swing about the swing center shafts and be retractable with respect to an electrophotographic photosensitive member in almost the radial direction. With this structure, the developer bearing member can be smoothly moved and stably positioned with respect to the electrophotographic photosensitive member, thereby stabilizing a developing state.

According to the above embodiment, the developing means includes the swing center shafts parallel with the electrophotographic photosensitive member incorporated in the process cartridge, and supports the developer bearing member to cause the developer bearing member to swing about the swing center shafts and be retractable with respect to an electrophotographic photosensitive member in almost the radial direction. With this structure, the developer bearing member can be smoothly moved and stably positioned with respect to the electrophotographic photosensitive member, thereby stabilizing a developing state.

According to the above embodiment, the distance between the center of the moving member of the developer bearing member and the center of the developer bearing member is set to be larger than the distance between the center of the moving member of the developing means and the swing center of the developer bearing member, thereby reducing the ratio of variations in contact pressure between the electrophotographic photosensitive member and the developer bearing member when the developer bearing member is driven through the gear.

According to the above embodiment, since the swing center of the developer bearing member is located downstream of the developer bearing member in the moving direction of the developer bearing member, the developer bearing member smoothly comes into contact with the electrophotographic photosensitive member and can move to the position where they oppose each other.

According to the above embodiment, since the electrophotographic photosensitive member and the developing means are mounted on the same member, a high relative position precision can be easily attained between the developer bearing member and the electrophotographic photosensitive member.

According to the above embodiment, since the process cartridge and the developing means are detachably positioned and mounted on the same member, a high relative position precision can be easily attained between the developer bearing member and the electrophotographic photosensitive member.

According to the above embodiment, the developing means includes a plurality of developing units each having a developer, a developer bearing member, and a developer coating member for the developer bearing member, and each developing unit is supported by the moving means of the developer bearing member such that the swing center line of the developer can pivot on one end of the swing center line toward the electrophotographic photosensitive member. With this structure, the parallelism between the electrophotographic photosensitive member and the developer bearing member can be ensured.

According to the above embodiment, the developer bearing member has the developer bearing member gear at its one end to receive a driving force, and the pivot center of the swing center line is located on the same side on which the developer bearing member gear is disposed. With this structure, the meshing depth between the developer bearing member gear and the driving gear, which meshes with the developer bearing member gear undergoes little change, and hence the developer bearing member gear receives a smooth driving force exhibiting little change in rotational torque.

According to the above embodiment, the round shaft and the round hole in which the round shaft is fitted are located on the pivot side of the swing center line, whereas the round shaft and the elliptic hole in which the round shaft is fitted to be movable in the crossing direction are located on the opposite side to the pivot side. With this simple structure, the developer bearing member can pivot with almost no increase in cost.

According to the above embodiment, since the direction of the elliptic hole is set with be parallel to the line connecting the center of the developer bearing member and the center of the electrophotographic photosensitive member, the developer bearing member can be accurately pressed against the electrophotographic photosensitive member even if the tolerance of the distance between the center of the electrophotographic photosensitive member and the center of the developer bearing member is increased.

What is claimed is:

1. An electrophotographic image forming apparatus capable of forming a multicolor image on a recording medium, comprising:

first mounting means for detachably mounting a photosensitive drum cartridge having an electrophotographic photosensitive drum; and second mounting means for detachably mounting at least a first developing cartridge and a second developing cartridge each including a developing roller for developing a latent image formed on said photosensitive drum, wherein a swing center of said each developing cartridge is swung with respect to a main body of said image forming apparatus, when said each developing roller is positioned at a developing position, said swing center being shiftable in a direction substantially parallel with a straight line connecting a rotational center of said photosensitive drum and a rotational center of said each developing roller.

2. An image forming apparatus according to claim 1, wherein positioning of said photosensitive drum cartridge and said each developing cartridge is performed by a common member.

3. An image forming apparatus according to claim 1, further comprising a rotary unit as said second mounting member capable of rotating about one shaft, and wherein a plurality of developing cartridges including said first and second developing cartridges are radially disposed around the rotational shaft of said rotary unit, so that upon developing said rotary unit rotates to a position where said each developing cartridge for performing development with a desired color toner opposes said photosensitive drum cartridge.

4. An image forming apparatus according to claim 1, wherein said swing center of each developing cartridge comprises a swing center located at a position where, when each said developing roller is located at the developing acting position, said developer roller is pressed against said photosensitive drum via an abutment roller.

5. An image forming apparatus according to claim 4, wherein said second mounting means of the at least said first developing cartridge and said second developing cartridge comprises a rotary unit for a developing cartridge body having a rotating direction thereof and the swing center of said at least first developing cartridge and second developing cartridge is located at a downstream side of said rotary unit.

6. An image forming apparatus according to claim 1, wherein said swing center of each developing cartridge comprises a swing center and a fitting hole in which a shaft of the swing center is fitted is an elliptic hole.

7. An image forming apparatus according to claim 6, wherein the elliptic hole is formed on a driven side.

8. An image forming apparatus according to claim 6, wherein each developing cartridge is brought into contact with an electrophotographic photosensitive drum via abutment rollers coaxially mounted on said each developing roller, a longitudinal direction of the elliptic hole being parallel to a straight line connecting a center of said photosensitive drum and a center of said each developing roller.

9. An image forming apparatus according to claim 3, wherein positioning of said photosensitive cartridge and said rotary unit is performed by a common member.

10. An electrophotographic image forming apparatus capable of forming a multicolor image on a recording medium, comprising:

developing means including a moving means for moving a plurality of developer bearing members for developing a latent image formed on an electrophotographic photosensitive drum by using toners, to a position opposed to said electrophotographic photosensitive drum and to a position not opposed thereto, along an arcuated locus; and conveying means for conveying the recording medium, wherein said developing means includes swing center shafts on said moving means, which move about a center of the arcuated locus to be parallel with said electrophotographic photosensitive drum associated with movement of said moving means, said each developer bearing member being supported on said moving means at a swing center thereof to be swung about each of said swing center shafts, said swing center being shiftable in a direction substantially parallel with a straight line connecting a rotational center of said photosensitive drum and a rotational center of said each developing bearing member.

11. An electrophotographic image forming apparatus in which a process cartridge can be detachably mounted and which can form a multicolor image on a recording medium, comprising:

mounting means for detachably mounting a process cartridge including an electrophotographic photosensitive member and process means acting on said electrophotographic photosensitive member;

developing means including a moving means for moving a plurality of developer bearing members for developing a latent image formed on an electrophotographic photosensitive drum by using toners, to a position opposed to said electrophotographic photosensitive drum and to a position not opposed thereto along an arcuated locus; and conveying means for conveying the recording medium, wherein said developing means includes swing center shafts on said moving means, which move about a center of the arcuated locus along the arcuated locus to be parallel with said electrophotographic photosensitive drum associated with movement of said moving means, said each developer bearing member being supported on said moving means at a swing center thereof to be swung about each of said swing center shafts, said swing center being shiftable in a direction substantially parallel with a straight line connecting a rotational center of said photosensitive drum and a rotational center of said each developing bearing member.

12. An image forming apparatus according to one of claims 10 and 11, wherein a distance between a center of said moving means of said each developer bearing member and a center of said each developer bearing member is larger than a distance between the center of said moving means of said each developer bearing member and a swing center of said each developer bearing member.

13. An image forming apparatus according to claim 12, wherein said each swing center of said developer bearing member is located downstream to said developer bearing member in a moving direction of said developer bearing member.

14. An image forming apparatus according to claim 10, wherein said electrophotographic photosensitive member and said developing means are mounted on the same member.

15. An image forming apparatus according to claim 11, further comprising a common member onto which said process cartridge is detachably mounted and onto which said developing means is mounted.

16. An image forming apparatus according to one of claims 10 and 11, wherein said developing means has a plurality of developing devices on said moving means, each of said developing means including a developer container, a developer bearing member, and developer coating means for said developer bearing member, and said developing devices are supported by said moving means such that a swing center line of said developing device can pivot on one end of the swing center line toward said electrophotographic photosensitive member.

17. An image forming apparatus according to claim 16, wherein said developer bearing member has a developer bearing member gear on one end thereof to receive a driving force, and a pivot center of the swing center line is located on the same side on which said developer bearing member gear is disposed.

18. An image forming apparatus according to claim 17, wherein a round shaft and a round hole in which the round shaft is fitted are located on a pivot side of the swing center line, and a round shaft and an elliptic hole in which the round shaft is fitted to be movable in a crossing direction are located on the opposite side to the pivot side.

19. An image forming apparatus according to claim 18, wherein a direction of the elliptic hole is parallel to a line connecting a center of said developer bearing member and a center of said electrophotographic photosensitive member.

20. An image forming apparatus comprising:

an image bearing member; and a developing unit for developing an electrostatic image formed on said image bearing member at a developing position using toner, said developing unit being capable of swinging between an operating position where a developing operation is effected and a non-operating position where the developing operation is not effected, and the non-operating position is positioned farther from said image bearing member than the operating position;

wherein a swing center around which said developing unit is swung between the operating position and the non-operating position is shiftable in a direction substantially parallel to a radius direction of said image bearing member at the developing position.

21. An image forming apparatus according to the claim 20, wherein said developing unit includes a developing roller for bearing and conveying the toner to the developing position, and the swing center is shiftable in a direction parallel to a line connecting a center of rotation of said image bearing member and a center of rotation of the developing roller.

22. An image forming apparatus according to claim 20, wherein said swing center is shiftable in a direction substantially parallel to the radius direction of said image bearing member at the developing position only in one end portion side in a longitudinal direction of said image bearing member.

23. An image forming apparatus according to claim 22, wherein said developing unit includes a developing roller for bearing and conveying the toner to the developing position, and receives a driving force for rotation of the developing roller in the one end portion side and an other end portion side in the longitudinal direction of said image bearing member.

24. An image forming apparatus according to claim 20, further comprising a swing shaft portion and a hole portion engaged with said swing shaft portion, for making the swing center shiftable in a direction substantially parallel to the radial direction of said image bearing member at the developing position, wherein said hole portion includes an elliptic hole portion.

25. An image forming apparatus according to claim 24, wherein said hole portion includes the elliptic hole portion for at one end portion of said swing shaft portion, and a round hole portion at the other end portion thereof.

26. An image forming apparatus according to claim 25, wherein said developing unit includes a developing roller for bearing and conveying the toner to the developing position, and the round hole portion is provided on an end portion side which is same side, in a longitudinal direction, where the developing roller receives a driving force for rotation.

27. An image forming apparatus according to claim 20, further comprising a rotary unit to rotatingly shift said developing unit to the other developing unit having a toner of the other color at the operating position, wherein the swing center is provided at a downstream side, in a rotation direction of said rotary unit, of the operating position.

28. An image forming apparatus according to claim 20, further comprising a rotary unit to rotatingly shift said developing unit to the other developing unit having a toner of the other color at the operating position, wherein said developing unit including a developing roller for bearing and conveying the toner to the developing position, and a distance between a center of rotation of the developing roller and a center of rotation of said rotary unit is greater than a distance between the center of rotation of the developing roller and the swing center.

29. An image forming apparatus according to claim 28, wherein the center of rotation of the developing roller, the center of rotation of said image bearing member, and the center of rotation of said rotary unit are positioned in a straight line.

30. An image forming apparatus according to any one of claims 22, 24, or 25, wherein said developing unit includes a developing roller for bearing and conveying the toner to the developing position, and a pair of abutting roller abutting against said image bearing member at both end portions in the longitudinal direction of the developing roller to form a gap between said image bearing member and the developing roller when said developing unit is positioned at the operating position.

31. An image forming apparatus according to claim 20, wherein said developing unit including a developing roller for bearing and conveying the toner to the developing position, and a roller gear receiving a driving force for rotating the developing roller, and a direction of the driving force received by the roller gear is the same as a direction in which said developing unit is provided with a rotation force to swing in a direction from the non-operating position to the operating position with respect to the swing center.

32. An image forming apparatus according to claim 31, further comprising a driving gear for providing the driving force to the driving roller, wherein said driving gear is provided so as to engage the roller gear with said driving gear when said developing unit is positioned at the operating position, and not to engage the roller gear with said driving gear when said developing unit is positioned at the non-operating position.

33. An image forming apparatus according to claim 20, wherein said image bearing member includes a photosensitive drum.

34. An image forming apparatus according to any one of claims 20 or 32, wherein said image bearing member is drum shaped.

* * * * *